US006609524B2

(12) United States Patent
Lloyd

(10) Patent No.: US 6,609,524 B2
(45) Date of Patent: Aug. 26, 2003

(54) DEVICE AND METHOD FOR STYLING HAIR

(76) Inventor: Lisa Lloyd, P.O. Box 31742, Tucson, AZ (US) 85750

( * ) Notice: Subject to any disclaimer, the term of this patent is extended or adjusted under 35 U.S.C. 154(b) by 0 days.

(21) Appl. No.: 09/887,813

(22) Filed: Jun. 25, 2001

(65) Prior Publication Data

US 2002/0195116 A1 Dec. 26, 2002

(51) Int. Cl.[7] ..... A45D 24/00; A45D 8/04
(52) U.S. Cl. ..... 132/200; 132/273
(58) Field of Search ..... 132/200, 207, 132/273, 276, 280, 281, 282, 283, 284

(56) References Cited

U.S. PATENT DOCUMENTS 1,330,802 A * 2/1920 Greenbowe ..... 132/283
1,357,271 A * 11/1920 Carlisle ..... 132/283
1,471,612 A * 10/1923 Kosatka et al. ..... 132/283
1,669,535 A * 5/1928 Reimann ..... 132/283
1,854,793 A * 4/1932 Hermsdorf ..... 132/283
2,268,629 A * 1/1942 Wardell ..... 132/283
2,620,808 A * 12/1952 Santis ..... 132/283
2,931,368 A * 4/1960 Fulton ..... 132/283
5,036,870 A * 8/1991 Edmark ..... 132/283
5,623,953 A * 4/1997 McDowell ..... 132/210
5,669,398 A * 9/1997 Dadgostar ..... 132/210
5,806,538 A * 9/1998 Keltner ..... 132/210
6,012,467 A * 1/2000 Kelsey ..... 132/280

* cited by examiner

*Primary Examiner*—John J. Wilson
*Assistant Examiner*—Robyn Kieu Doan

(57) ABSTRACT

The invention is in one embodiment a means for holding a hairstyle. The means for holding a hairstyle includes a first member, a second member, and a connecting means for rigidly coupling the first member to the second member. In another embodiment the invention is a styling device. The hair styling device uses a first elongated portion, a second elongated portion, and an intermediate portion that rigidly couples the first elongated portion to the second elongated portion. The invention is also a method of styling hair that secures a hair-do, and inserts a styling device into the hair-do to hold the hair-do.

13 Claims, 7 Drawing Sheets

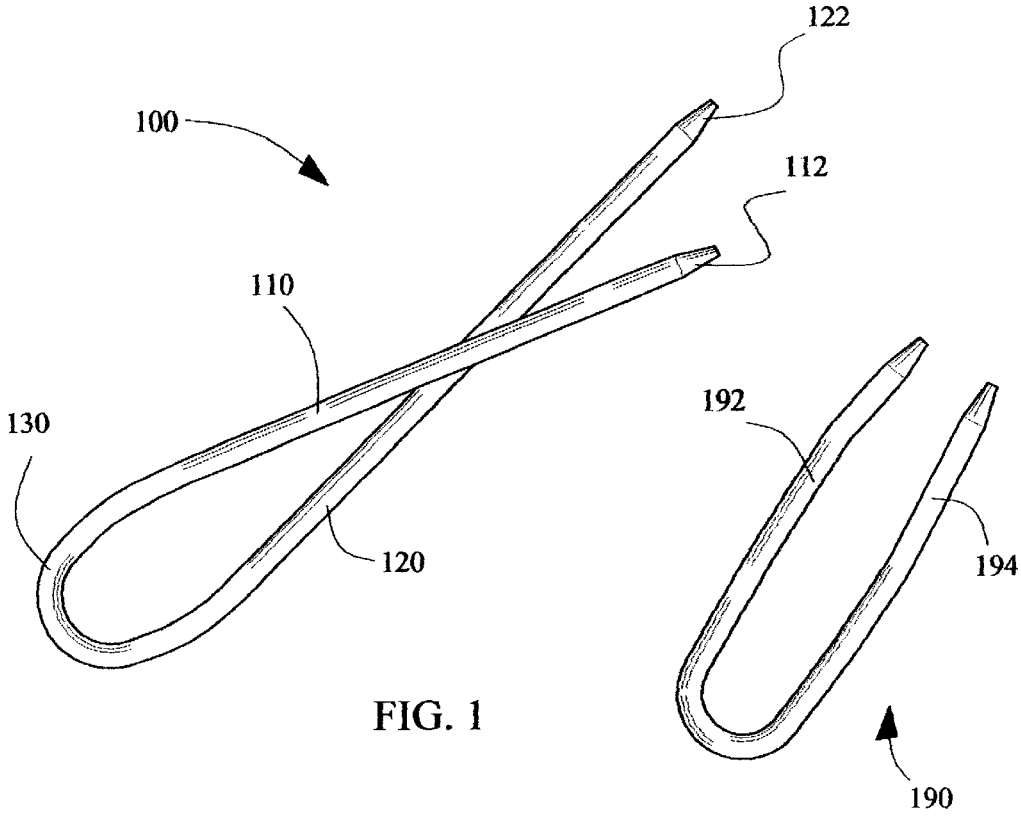
FIG. 1
FIG. 2
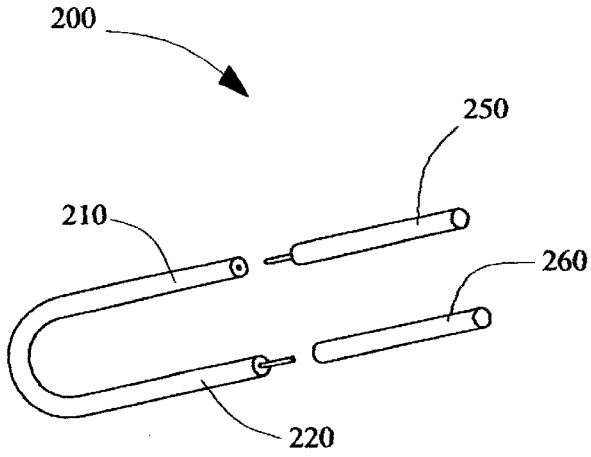

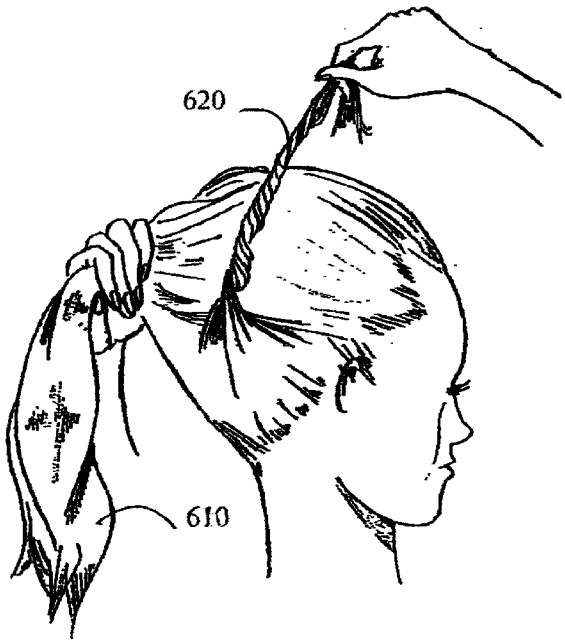
FIG. 6a
FIG. 6b
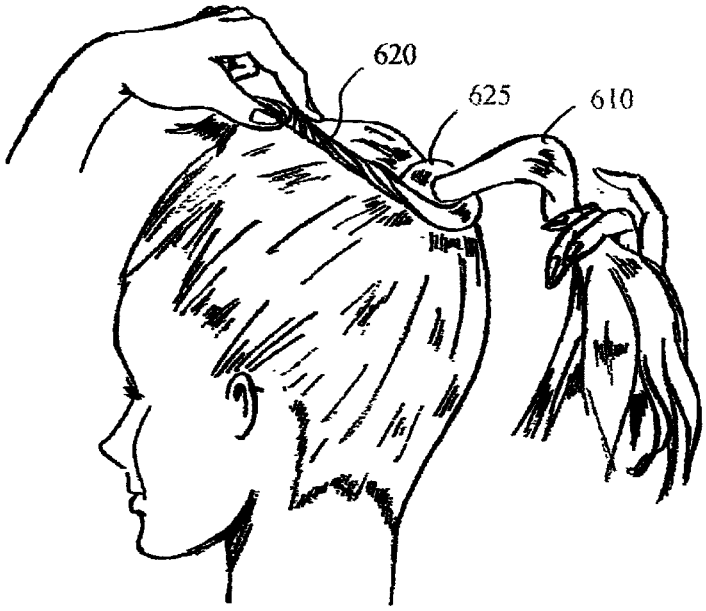

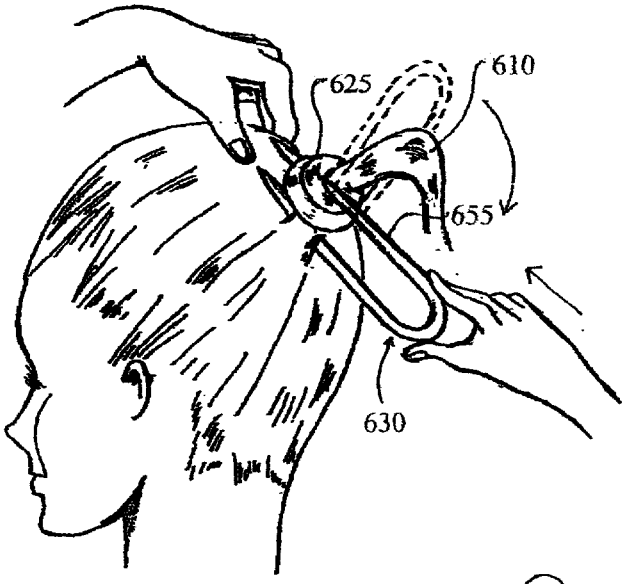
FIG. 6c
FIG. 6d
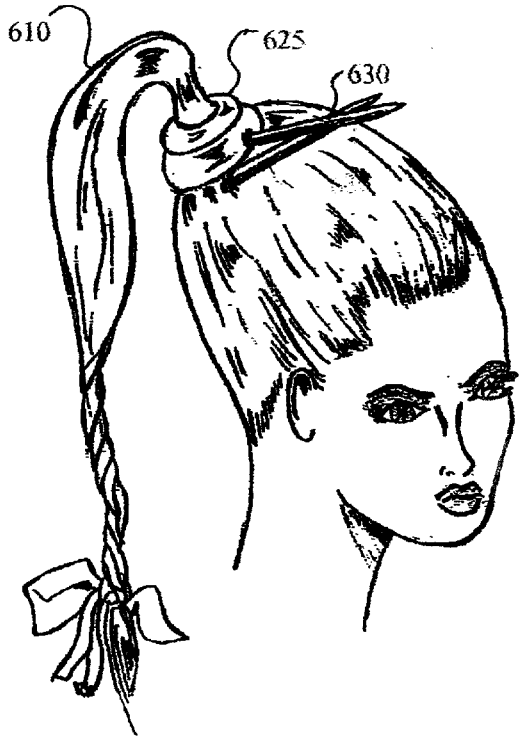

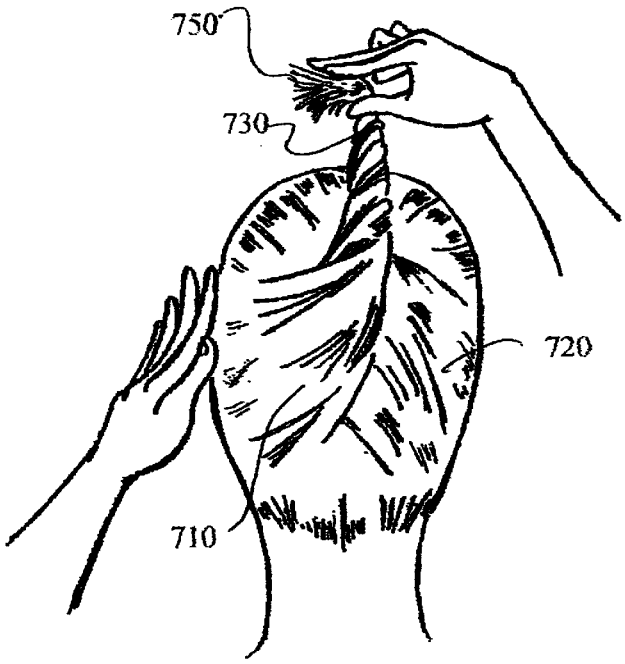
FIG. 7a
FIG. 7b
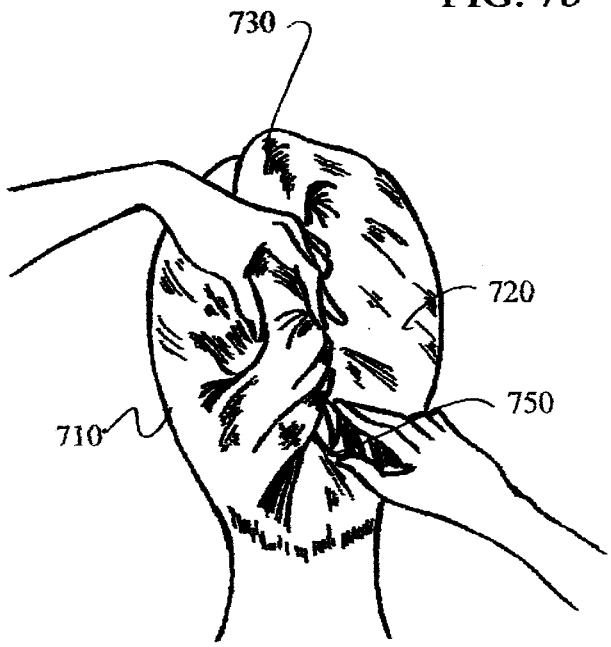

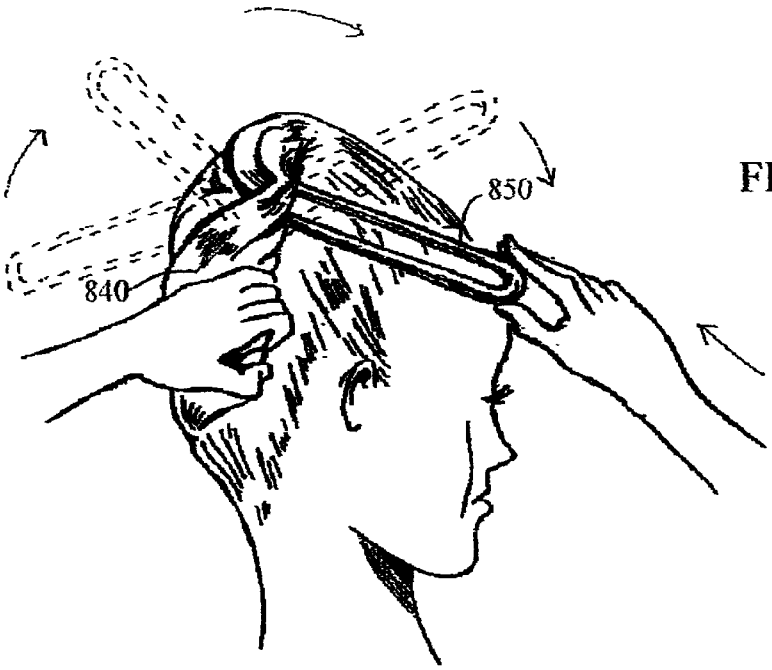
FIG. 8a
FIG. 8b
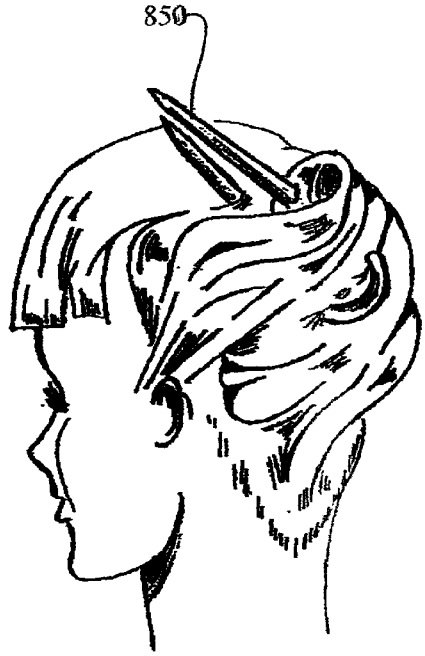

DEVICE AND METHOD FOR STYLING HAIR

TECHNICAL FIELD

Generally, the invention relates to the field of hair care, and, more specifically, the invention relates to devices and methods for styling hair.

STATEMENT OF A PROBLEM ADDRESSED BY THIS INVENTION

Many women with long or medium length hair wear their hair in "buns" (or "twist") for reasons of styling or convenience. This allows for hair to be worn underneath hats or other accessories. In addition, it allows hair to be easily held in place during sporting events. Typically, to achieve a bun hair is brushed or pulled to its full length, and then twisted or braided. Then, the hair is rolled into a bun in a manner well known to most women. To hold the bun in place, typically a clip, bobby pins, or a pair of sticks is placed through the bun. The clips or pins cause the bun to stay in place. However, keeping a bun in place is difficult, as there are inadequacies with devices and methods for holding buns.

For example, to get a secure hold on a bun when using bobby pins, many bobby pins must be used. If sticks are used to hold the bun in place, it usually requires two or more sticks to securely hold the bun. Sticks suffer from the additional drawbacks of protruding from the bottom of the hair—this makes the wearing of hats and other accessories practically impossible. In addition, since multiple sticks are needed, the loss of a stick renders the set of sticks useless, if one is to maintain a matching set of sticks. Accordingly, to overcome these and other disadvantages associated with existing methods of styling hair, it would be advantageous to provide devices and methods of styling hair in a single unit that does not impede the use of accessories, that is practically invisible in the hair to a casual observer, and that can provide attractive and fashionable attachments and embodiments.

SELECTED OVERVIEW OF SELECTED EMBODIMENTS

The invention provides technical advantages as devices and methods for styling hair. The invention is in one embodiment a means for holding a hairstyle. The means for holding a hairstyle includes a first member, a second member, and a connecting means for rigidly coupling the first member to the second member. In another embodiment the invention is a styling device. The hair styling device uses a first elongated portion, a second elongated portion, and an intermediate portion that rigidly couples the first elongated portion to the second elongated portion. The invention is also a method of styling hair that secures a hair-do, and inserts a styling device into the hair-do to hold the hair-do.

Accordingly, the invention provides the advantage of securing a hair-do using a single styling device, as opposed to using many bobby pins as is required to hold hair with bobby pins. In addition, in one embodiment the invention provides the advantage of having the appearance of being two sticks, such as chopsticks, rather than requiring two sticks to hold a hair-do in place, along with the additional advantage of not protruding from the bottom of the hair-do. Yet another advantage of the invention is that hats and other accessories may be worn in conjunction with the invention. In one embodiment the invention is a single, integrally formed, unified device.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as an embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which:

FIG. 1 shows a first embodiment and a second embodiment of the invention;

FIG. 2 shows an alternative embodiment of a styling device;

FIGS. 6*a*–6*d* provide stepwise illustrations for a hairstyle with a wrap that uses the invention;

FIGS. 7*a* and 7*b* show a tuck hairstyle incorporating the invention; and FIGS. 8*a* and 8*b* provide a method for using the invention to secure a side-flop hairstyle.

AN EXEMPLARY EMBODIMENT OF A BEST MODE

Figure 3:
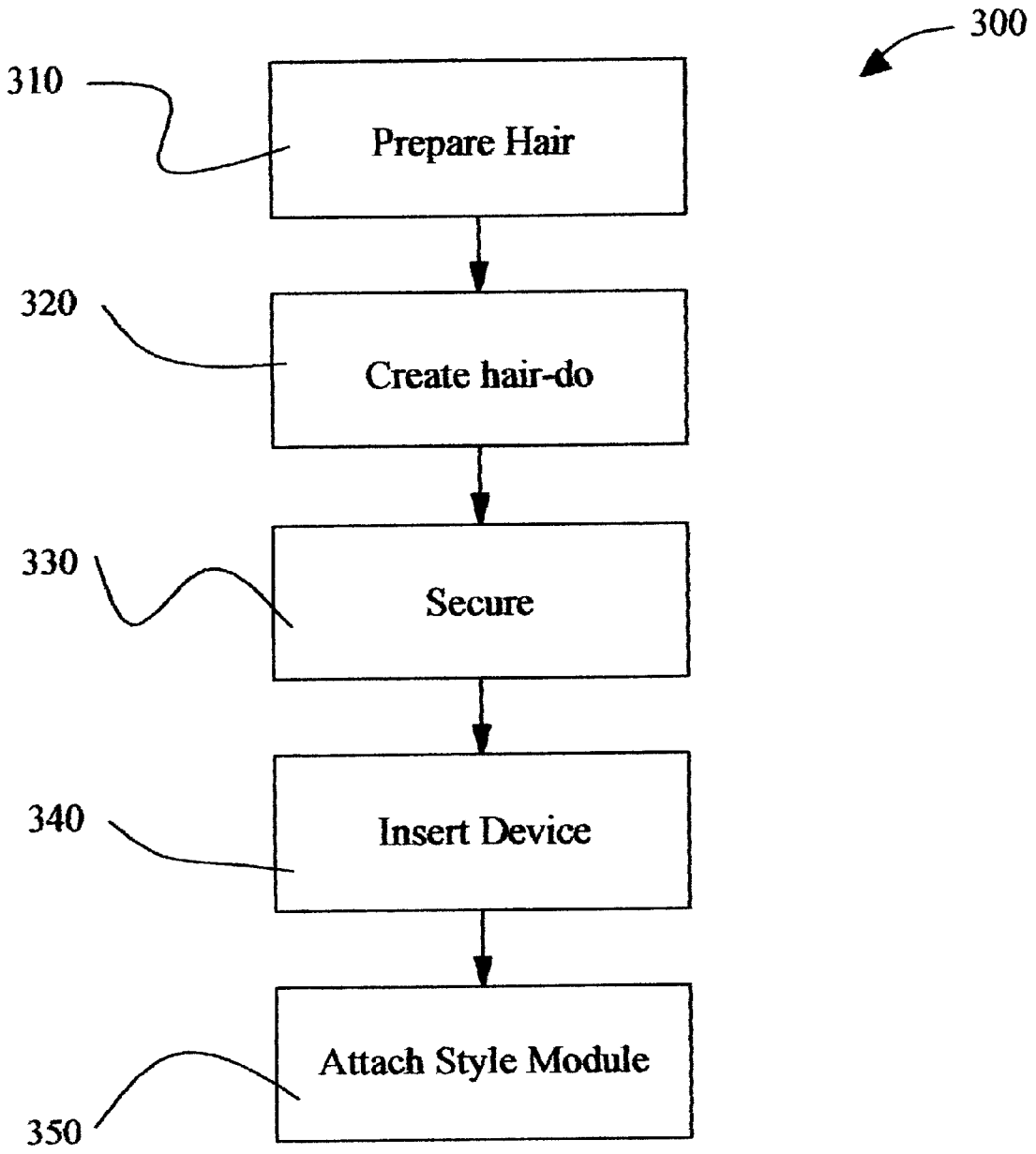
FIG. 3 is a block flow diagram of styling hair.

The invention provides the advantage of securing a hair-do using a single styling device. The invention is in one embodiment a means for holding a hairstyle that incorporates a first member, a second member, and a connecting means for rigidly coupling the first member to the second member. In another embodiment the invention is a styling device that includes a first elongated portion, a second elongated portion, and an intermediate portion that rigidly couples the first elongated portion to the second elongated portion. The invention is also a method of styling hair that secures a hair-do, and inserts a styling device into the hair-do to hold the hair-do. In one embodiment the invention provides the advantage of having the appearance of being two sticks, such as chopsticks, rather than requiring two sticks to hold a hair-do in place. In addition, the invention does not protrude from the bottom of the hair-do, so hats and other accessories may be worn in conjunction with the invention.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning-" or "step for—functioning-" in the Claims section.

DESCRIPTIONS OF THE FIGURES

The invention may be better understood by examining drawings. Accordingly, FIG. 1 shows a first embodiment and a second embodiment of the invention. The invention is a means for holding a hairstyle that is used to style hair that is typically in a hair-do, such as a bun. In general, the means for holding hair includes a first member and a second member, which are preferably elongated portions, that are coupled to each other via a connecting means. The means for holding a hairstyle may be embodied as a first styling device 100 that has a first elongated portion 110 and a second elongated portion 120 that are coupled together via an intermediate portion 130. The intermediate portion 130 preferably rigidly couples the first elongated portion 110 to the second elongated portion 120. The intermediate portion is generally the bend of a styling device when the styling device is a single, integral device.

Likewise, when the styling device is comprised of separate elongated portions and a separate intermediate portion, the intermediate portion may comprise a rigid material that is bent, and is adapted to accept a first elongated portion and a second elongated portion. The styling device may be made of different materials, or the styling device may be a uniform material. For example, in some embodiments it may be advantageous to make the intermediate portion out of a first, rigid material, and the elongated portions out of a more flexible, softer material. In other embodiments, it may be advantageous to create the styling device out of a single material that balances the goals of rigidity, flexibility, and resistance to chemicals, for example. In a preferred embodiment, the elongated portions 110, 120 are formed to look like chopsticks.

The elongated portions 110, 120 of the first styling device 100 terminate in points 112, 122. However, it should be understood that the elongated portions 110, 122 may terminate in any number of functional or ornamental designs. In addition, the first elongated portion 110 may be longer or shorter than the second elongated portion 120. In FIG. 1 a second styling device 190 is illustrated to show that a first elongated portion 192 and the second elongated portion 194 do not have to cross, but may be rigidly maintained in any desired configuration, although a generally parabolic configuration is preferred.

FIG. 2 shows an alternative embodiment of a styling device 200. The styling device 200 has elongated portions 210, 220 that are adapted to receive style modules 250, 260. Style modules may be any ornamental attachment designed to enhance the appearance of styling devices, and/or to better hold a hair-do. In one embodiment, the style modules are glow-in-the-dark stick modules, chopstick modules, or feather-stick modules, for example. Of course, style modules may be mixed and matched with different elongated portions to enable a person to make a unique fashion statement.

Figure 4:
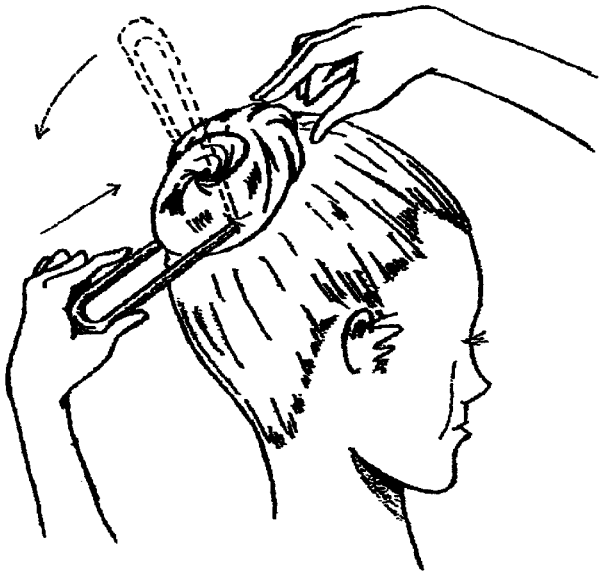
FIG. 4 illustrates the insert device act.
Figure 5:
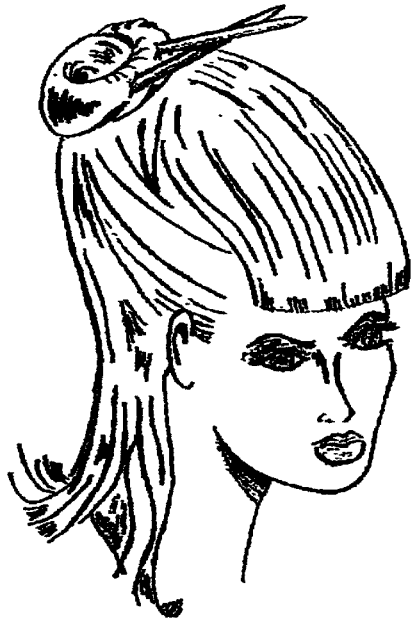
FIG. 5 illustrates the styling device placed in a hair-do, and is shown holding the hair-do.

The invention is also a method of styling hair. FIG. 3 is a block flow diagram of a method of styling hair (the method) 300. The method 300 begins with a prepare hair act 310 where a user may comb or braid hair. Next, in a create hair-do act 320, a hair-do is made. Preferably, the hair-do is a twisted hair-do, such as a bun. However, it should be understood that any bundling of hair is acceptable and within the scope of the invention. After the create hair-do act 320, the method 300 continues with a secure act 330. In the secure act 330 the hair, in the form of a hair-do, is secured with a hand or with a hair styling tool so that the hair will not move significantly when a pressure is applied to it. Then a styling device is placed in the hair in an insert device act 340. FIG. 4 illustrates the insert device act 340. In FIG. 4 it can be seen that the device is preferably inserted into the hair-do from the bottom of the hair-do so that the elongated portions protrude up and away from the hair-do. This allows for the attachment of selected styling module in an attach style module act 350. The styling device is also preferably inserted by passing the styling device close to the scalp. Following the attach style module act 350, the styling device may be hidden or adjusted to a preferred location or configuration. FIG. 5 illustrates the styling device placed in a hair-do, and is shown holding the hair-do.

FIGS. 6*a*–6*d* provide stepwise illustrations for a hairstyle with a wrap that uses the invention. FIG. 6*a* shows that after a hair is pulled or combed to a length of hair 610, a small portion of the hair, preferably substantially from a side, is twisted into a mini-ponytail 620. Then, the mini-ponytail 620 is wrapped around the length of hair 610, as illustrated in FIG. 6*b*, to create a wrap 625. A styling device 630 is next inserted into the hairstyle as shown in FIG. 6*c*; note that in a preferred embodiment, one elongated portion 655 of the styling device 630 passes over the top of part of the wrap 625, and then extends below the wrap 625. FIG. 6*d* illustrates the styling device 630 placed in a hairstyle with a wrap, and is shown holding the wrap. Although illustrated as being in the back of the head, the ponytail with a wrap may be created at any location on the head having sufficient hair.

FIGS. 7*a* and 7*b* show a tuck hairstyle incorporating the invention. First, the hair is pulled or combed into two halves.

Next, the two halves are brought together and twisted to create a first half 710, a second half 720, and a common twisted end 730, as illustrated in FIG. 7*a*. The twisted end 730 is then passed underneath the first half 710 and the second half 720, and a tip 750 of the twisted end is pulled through, as shown in FIG. 7*b*. Next, a styling device may be inserted into the tucked hairstyle, preferably at the point where the tip 750 protrudes form the hair, and thus secure the tucked hairstyle.

FIGS. 8*a* and 8*b* provide a method for using the invention to secure a side-flop hairstyle. First, the hair is prepared as shown in FIGS. 7*a* and 7*b* create a first half 810, a second half 820, and a common twisted end 830 that is pulled underneath the first half 810 and the second half 820. Next, either half 810, 820 is pulled to the side to create a tucked half 840, and a styling device 850 is inserted at the top of the hairstyle and rotated about the tucked half 840, as shown in FIG. 8*a*. Then, the styling device 850 is pushed through the hairstyle. This provides a secure foundation of hair so that the tucked half 840 may then be un-tucked and allowed to "flop" over the styling device 850.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

I claim:

1. A method of styling hair, comprising:

preparing the hair combing or braiding the hair;

separating hair into a first half and a second half of combed hair, tying the first half and the second half together to create a common twisted end, pulling either the first half or the second half to a side to create a tucked half, inserting the styling device into the top of the tucked half, rotating the styling device about the tucked half, pushing the tucked half through the hairstyle to secure the hairstyle, untucking the tucked half and allowing the tucked half to "flop" over the styling device;

securing the hairdo; and inserting a styling device having two non-parallel, non-planar, crossing and elongated portions into the hair-do to hold the hairdo by inserting the device from the bottom of the hairdo so that the elongated portions visibly protrude up and away from the hairdo.

2. The method of claim 1 further comprising the act of securing the styling device.

3. The method of claim 1 further comprising the act of hiding the styling device from view.

4. The method of claim 1 further comprising attaching a style module to the styling device.

5. A method of styling hair, comprising:

preparing the hair by combing or braiding the hair;

wrapping a mini ponytail around a length of hair to create a wrap, and wherein the act of inserting a styling device comprises inserting one elongated portion of the styling device over the top part of the wrap and then extending the elongated portion below the wrap;

securing the hairdo; and inserting a styling device having two non-parallel, non-planar, crossing and elongated portions into the hair-do to hold the hairdo by inserting the device from the bottom of the hairdo so that the elongated portions visibly protrude up and away from the hairdo.

6. A styling device, comprising:

a first elongated portion having a first tip;

a second elongated portion having a second tip;

an intermediate portion that rigidly couples the first elongated portion to the second elongated portion; and a first styling module coupled to the first tip and a second styling module coupled to the second tip, the styling device securing a mini ponytail twisted hairdo that is created by inserting the styling device into the hairdo from the bottom of the hairdo so that the elongated portions protrude visibly up and away from the hairdo while the intermediate portion is not visible.

7. The styling device of claim 6 wherein the first elongated portion and the second elongated portion terminate in points.

8. The styling device of claim 6 wherein the first elongated portion, the second elongated portion, and the intermediate portion are a uniform material.

9. The styling device of claim 6 wherein the first elongated portion, the second elongated portion, and the intermediate portion are integrally formed.

10. The styling device of claim 6 wherein the first elongated portion is longer than the second elongated portion.

11. The styling device of claim 6 wherein the first elongated portion is enabled to receive a style module.

12. The styling device of claim 11 wherein the first elongated portion is enabled to receive a second style module.

13. The styling device of claim 12 wherein the style module and the second style module are chopstick style modules.

* * * * *